US005891823A

United States Patent [19]

Torii et al.

[11] Patent Number: 5,891,823

[45] Date of Patent: Apr. 6, 1999

[54] REVERSIBLE THERMOSENSITIVE RECORDING MEDIUM

[75] Inventors: Masafumi Torii, Shizuoka; Hiroaki Matsui, Numazu; Hiromi Furuya, Shizuoka-ken; Fumio Kawamura, Shizuoka; Kyoji Tsutsui, Mishima; Katsushi Sugiyama, Inzai; Katsuaki Kokubo, Katsushika-ku; Katsuhisa Kamio, Kakamigahara; Kazuo Hosoda, Miyashiro-machi; Masafumi Moriya, Kasukabe, all of Japan

[73] Assignee: Ricoh Company Ltd., Tokyo, Japan

[21] Appl. No.: 870,925

[22] Filed: Jun. 6, 1997

[30] Foreign Application Priority Data

Jun. 6, 1996 [JP] Japan ..... 8-166894
Jun. 4, 1997 [JP] Japan ..... 9-161908

[51] Int. Cl.[6] ..... B41M 5/30; B41M 5/34

[52] U.S. Cl. ..... 503/216; 503/201; 503/225

[58] Field of Search ..... 427/150; 503/201, 503/216, 225

[56] References Cited

FOREIGN PATENT DOCUMENTS 0574879 12/1993 European Pat. Off. ..... 503/201
9277708 10/1997 Japan ..... 503/201
9295458 11/1997 Japan ..... 503/201

*Primary Examiner*—Bruce H. Hess
*Attorney, Agent, or Firm*—Cooper & Dunham LLP

[57] ABSTRACT

A reversible thermosensitive medium having a support and a thermosensitive layer, the layer comprising a composition including a coloring agent and a developer and capable of assuming a colored state and a discolored state depending upon the thermal hysteresis thereof. The developer is a phenol compound represented by the formula:

wherein n is an integer of between 1 and 3, X represents a divalent group having a nitrogen atom or an oxygen atom, $R^1$ represents a substituted or non-substituted aliphatic hydrocarbon group having at least two carbon atoms and $R^2$ represents a hydrocarbon group. A reversible thermosensitive recording medium has a thermosensitive recording layer containing the above composition.

1 Claim, 1 Drawing Sheet

REVERSIBLE THERMOSENSITIVE RECORDING MEDIUM

BACKGROUND OF THE INVENTION

This invention relates to a thermosensitive coloring composition capable of reversibly assuming a color development state and a decolorization state depending upon the thermal hysteresis thereof and to a reversible thermosensitive recording medium using the above-mentioned coloring composition.

There is a known thermosensitive recording medium utilizing the coloring reaction between an electron donating compound (hereinafter referred to as a coloring agent) and an electron accepting compound (hereinafter referred to as a developer). This kind of thermosensitive recording medium is widely used in a variety of applications such as recorders and printers for an electronic computer, a scientific measuring instrument, a facsimile apparatus, a word processor, an automatic ticket vending apparatus and a CRT medical measuring instrument. The known thermosensitive recording media currently actually used are of an irreversible type in which the color development and decolorization cannot be repeated.

There are a number of proposals for a reversible thermosensitive recording medium utilizing a combination of a coloring agent with a developer and capable of reversibly assuming a color development state and a decolorization state. For example, JP-A- (Japanese Laid-Open Patent Application No.) 60-193691 proposes the use of a developer composed of a blend of gallic acid with fluoroglucinol and JP-A-60-237684 proposes the use of phenolphthalein or thymolphthalein as a developer. JP-A-62-138556, 62-138568 and 62-140881 suggest a reversible thermosensitive recording layer containing a homogeneous mixture a coloring agent, a developer and a carboxylic acid ester. JP-A-63-173684 proposes the use of an ascorbic acid derivative as a developer, while JP-A-2-188293 and 188294 disclose the use of a higher fatty amine salt of gallic acid or bis(hydroxyphenyl)acetic acid as a developer. The known reversible thermosensitive recording media are, however, unsatisfactory for use in practice. In particular, with the known recording media, it is impossible to obtain both excellent color development state and excellent decolorization state or to obtain a constant image density even when the same recording condition is used.

JP-A-5-124360 and JP-A-6-210954 disclose a thermosensitive coloring composition containing a leuco compound serving as a coloring agent and an organic phosphoric acid compound, a phenolic compound or a carboxylic compound with a long chain aliphatic group as a developer, and a reversible thermosensitive recording medium utilizing the above coloring composition. The coloring composition can assume a the color development state when heated at a first temperature and the developed color can be retained when rapidly cooled to room temperature. Further, the developed image can be erased when heated at a second temperature which is lower than the first temperature and the decolorization state is retained when cooled to room temperature. This thermosensitive recording medium gives a satisfactory image density. However, from the standpoint of practical use, there is a problem that the recording medium fails to give both high disclorization speed and good storage stability.

SUMMARY OF THE INVENTION

It is, therefore, an object of the present invention to provide a thermosensitive coloring composition which can reversibly assume color development and decolorization states depending upon the thermal hysteresis thereof and which is devoid of the drawback of the conventional coloring composition.

Another object of the present invention is to provide a thermosensitive coloring composition of the above-mentioned type which gives a high color density in the color development state but an extremely low color density in the decolorization state.

It is an important object of the present invention to provide a thermosensitive coloring composition of the above-mentioned type which can be quickly converted from the color development state to the decolorization state and which has good heat resistance and high storage stability.

It is yet a further object of the present invention to provide a reversible thermosensitive recording medium having a thermosensitive layer formed of the above thermosensitive coloring composition.

It is yet a further object of the present invention to provide a reversible thermosensitive recording medium of the above-mentioned type having good heat resistance, light-fastness and durability.

In accomplishing the foregoing objects, there is provided in accordance with the present invention a reversible thermosensitive composition comprising an electron donating coloring compound and an electron accepting compound and capable of assuming a relatively colored state and a relatively discolored state depending upon the temperature at which said composition is heated and/or the rate at which the heated composition is cooled, characterized in that said electron accepting compound is a phenol compound represented by the formula:

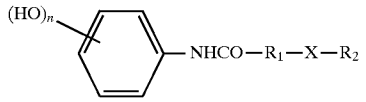

wherein n is an integer of between 1 and 3, X represents a divalent group having a nitrogen atom or an oxygen atom, $R^1$ represents a substituted or non-substituted aliphatic hydrocarbon group having at least two carbon atoms and $R^2$ represents a hydrocarbon group.

In another aspect, the present invention provides a reversible thermosensitive recording medium, comprising a support, and a thermosensitive recording layer supported on said support and including the above thermosensitive composition.

BRIEF DESCRIPTION OF THE DRAWING

Other objects, features and advantages of the present invention will become apparent from the detailed description of the preferred embodiments of the invention which follows, when considered in the light of the accompanying drawing in which.

DETAILED DESCRIPTION OF THE PREFERRED EMBODIMENTS OF THE INVENTION

Figure 1:
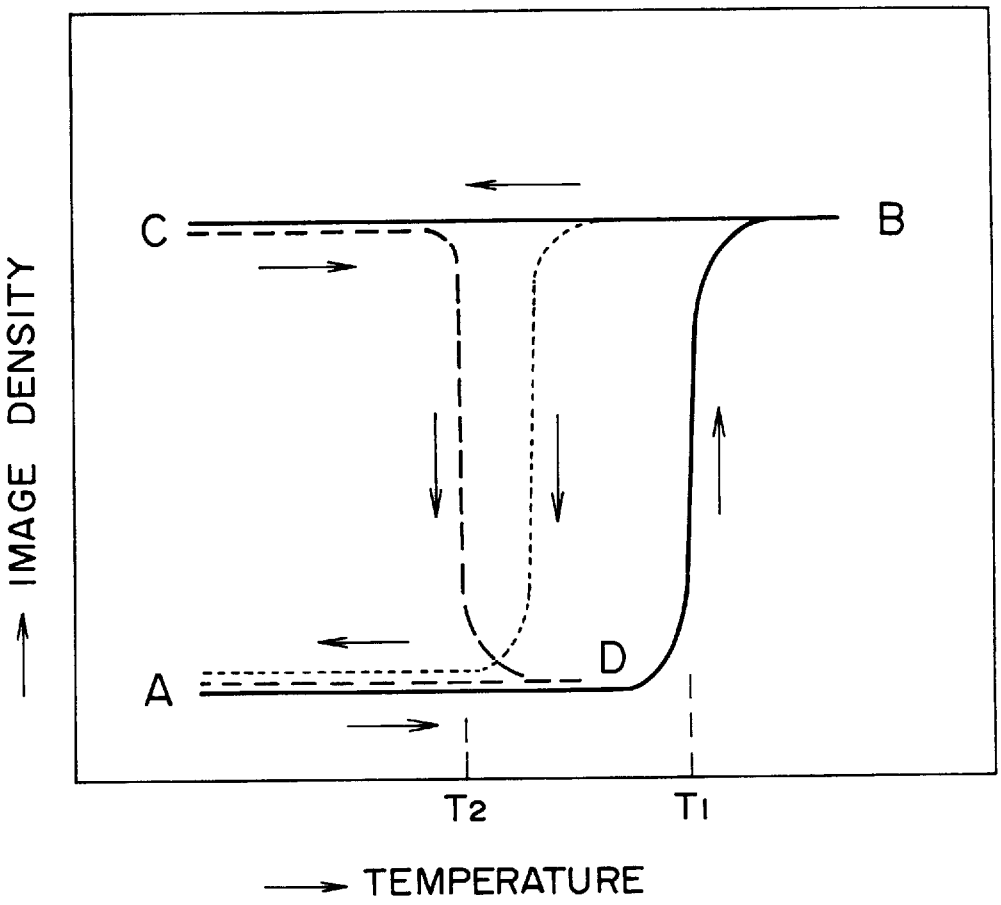
FIG. 1 is a graph which shows the relationship between the image density and the temperature of a reversible thermosensitive recording medium of the present invention and which is explanatory of the principle of the reversible change between a color development state and a decolorization state depending upon the thermal hysteresis thereof.

The reversible thermosensitive recording medium according to the present invention includes a support having supported thereon a thermosensitive recording layer. Any material that can support the thermosensitive recording layer may be used as the support. Examples of suitable support include paper, synthetic paper, plastic film, a glass plate, a metal foil and composite sheets thereof.

The thermosensitive recording layer includes a thermosensitive composition containing an electron donating coloring compound and an electron accepting compound which is a phenol compound represented by the formula (1): wherein n is an integer of between 1 and 3, X represents a divalent group having a nitrogen atom or an oxygen atom, $R^1$ represents a substituted or non-substituted aliphatic hydrocarbon group having at least two carbon atoms and $R^2$ represents a hydrocarbon group such as an aliphatic hydrocarbon group, an aromatic hydrocarbon group or a group containing both aromatic and aliphatic radicals.

In the phenol compound of the formula (1), the aliphatic hydrocarbon group represented by $R^1$ and $R^2$ may be linear or branched, may contain one or more unsaturated bonds and may contain one or more substituents such as a hydroxyl-group, a halogen atom and an alkoxy group. For reasons of stability in the color development state and of erasability, it is preferred that the total carbon atoms of $R^1$ and $R^2$ be at least 8, more preferably at least 11.

Illustrative of suitable aliphatic groups $R^1$ are as follows:

$-(CH_2)_q-$ $-(CH_2)_q-CH=CH-(CH_2)_{q'}-$ $-(CH_2)_q-CH(CH_2)_{q''}-CH_3-(CH_2)_{q'}-$ $-(CH_2)_q-CH(CH_2)_{q''}-Cl-(CH_2)_{q'}-$ $-(CH_2)_q-C(CH_2)_{q''}-CH_3(CH_2)_{q'''}-CH_3-(CH_2)_{q'}-$ $-(CH_2)_q-CH(CH_2)_{q''}-OH-(CH_2)_{q'}-$ wherein q, q', q", q'" each represent an integer which meets with the condition of the carbon number of $R^1$.

Illustrative of suitable hydrocarbon groups $R^2$ are as follows:

$-(CH_2)_q-CH_3$ $-(CH_2)_q-CH=CH-(CH_2)_{q'}-CH_3$ $-(CH_2)_q-C_6H_4-(CH_2)_{q'}-CH_3$ $-(CH_2)_q-C_6H_5$ $-(CH_2)_q-C_6H_4Cl$ $-(CH_2)_q-CH(CH_2)_{q''}-CH_3-(CH_2)_{q'}-CH_3$ $-(CH_2)_q-CH(CH_2)_{q''}-Cl-(CH_2)_{q'}-CH_3$ $-(CH_2)_q-C(CH_2)_{q''}-CH_3(CH_2)_{q'''}-CH_3-(CH_2)_{q'}-CH_3$ $-(CH_2)_q-CH(CH_2)_{q''}-OH-(CH_2)_{q'}-CH_3$ wherein q, q', q", q'" each represent an integer which meets with the condition of the carbon number of $R^2$.

The oxygen- and/or nitrogen-containing divalent group X is preferably a group containing at least one linkage Z selected from —NH—, —CO—, —O—, and —$SO_2$—. Preferably, the divalent group X is Z itself or —Z—$(R^3$—Y$)_p$— wherein $R^3$ is a divalent hydrocarbon group, Y is selected from —NH—, —CO—, —O—, and —$SO_2$— and p is an integer of 1–4. Thus, the phenol compound of the formula (1) is preferably a compound of the following formula (1') or (2):

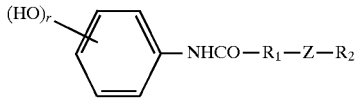

(1')

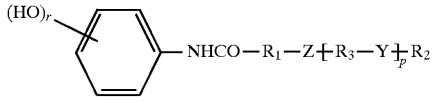

(2)

wherein $R^1$, $R^2$, $R^3$, Z and Y are as defined above and n and r are each an integer of 1–3.

Illustrative of suitable divalent linkages Z are an urea linkage (—NH—CO—NH—), an amide linkage (—NH—CO— or —CO—NH—), a thiourea linkage (—NH—CS—NH—), an urethane linkage (—O—CO—NH— or —NH—CO—O—), an amine linkage (—NH—), an azomethyne linkage (—CH=N— or —N=CH—), an ester linkage (—O—CO— or —CO—O—), a thioester linkage (—SC—O— or —CO—S—), an ether linkage (—O—), a sulfonyl linkage (—$SO_2$—), a sulfonamide linkage (—$SO_2$—NH— or —NH—$SO_2$—), a carbonyl linkage (—CO—), —O—CS—NH—, —NH—CS—O—, —O—CO—O—, —CO—NH—CO—, —CO—NH—CO—NH—, —NH—CO—NH—CO—, —CO—NH—NH—CO—, —NH—CO—CO—NH—, —CO—NH—NH—CO—O—, —CO—NH—NH—CO—NH—, —NH—CO—NH—NH—CO—, —NH—CO—NH—NH— and —NH—NH—CO—NH—.

Examples of the phenol compounds suitably used for the purpose of the present invention include the compounds of the following formulas (3)–(10):

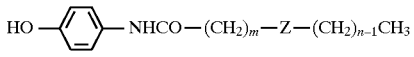

(3)

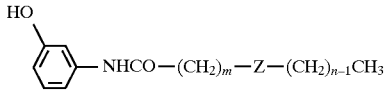

(4)

-continued

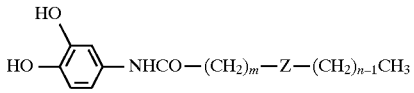

(5)

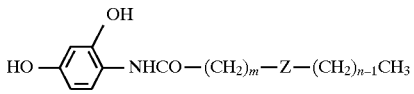

(6)

-continued
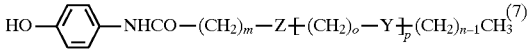
(7)
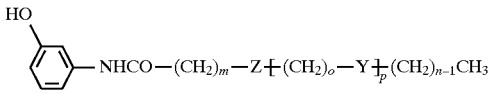
(8)
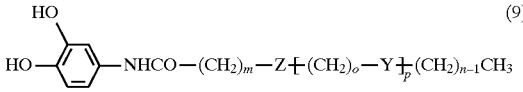
(9)
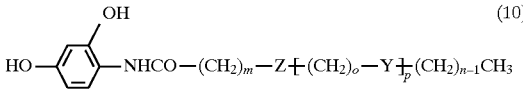
(10)
wherein n and o independently represent an integer between 1 and 22, m represents an integer between 2 and 22 and p represents an integer between 1 and 4, provided that the total number of m, n and o is at least 8, and Z and Y have the same meaning as above.
Specific examples of the phenol compounds represented by the formula (3) include:
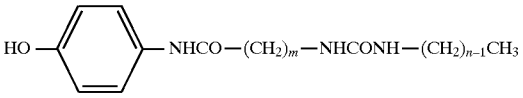
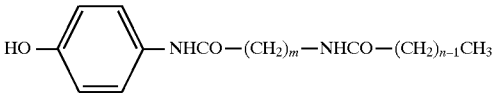
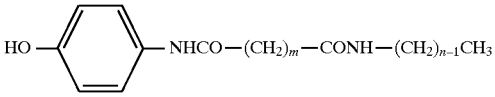
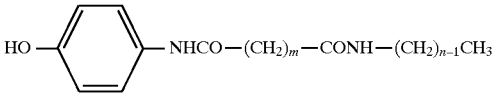
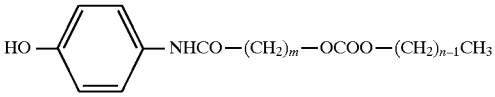
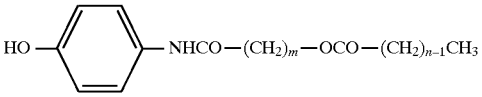
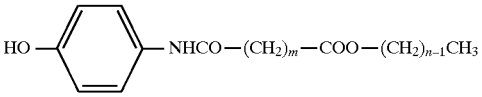
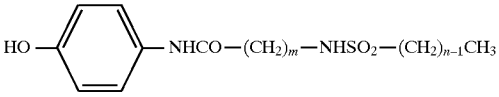
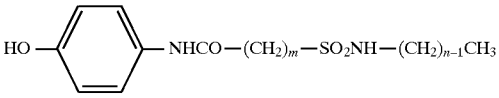
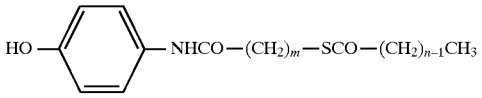
-continued
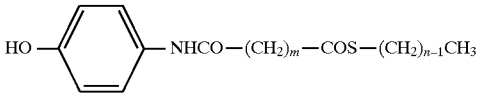
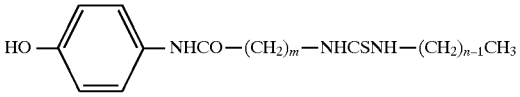
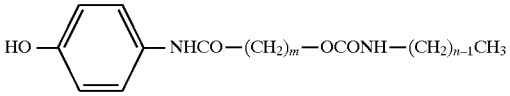
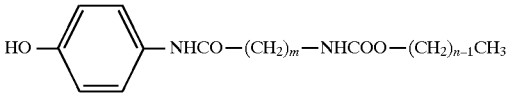
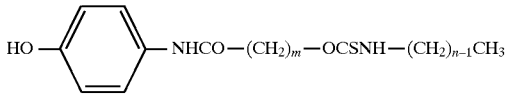
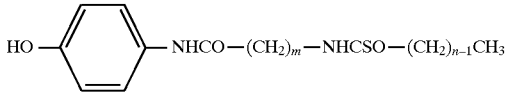
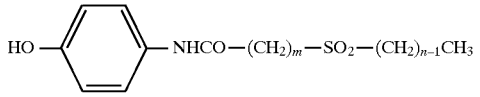
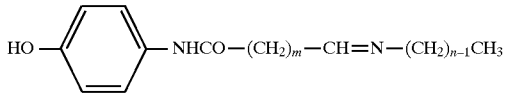
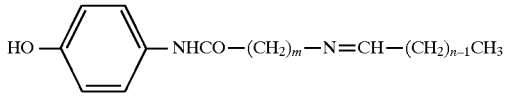
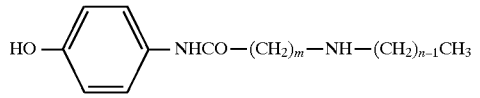
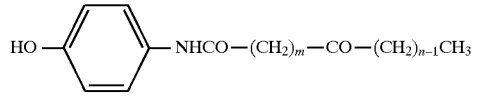
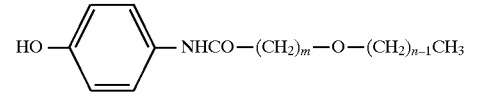
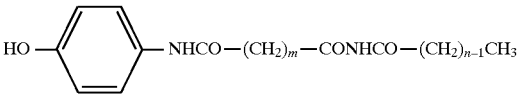
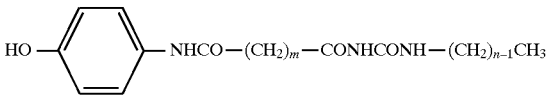
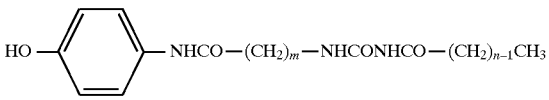

-continued
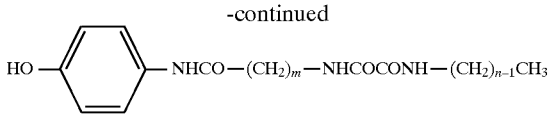
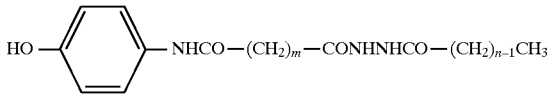
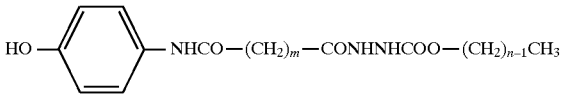
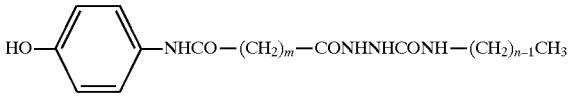
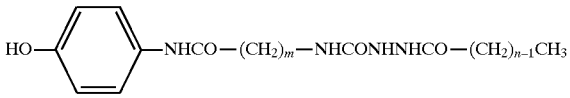
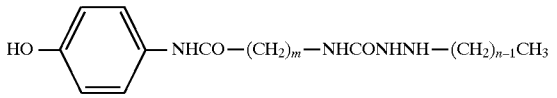
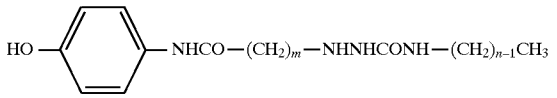
Particularly preferred phenol compounds are those having an amide linkage or a urea linkage as the divalent group X. Illustrative of such phenol compounds are as follows:
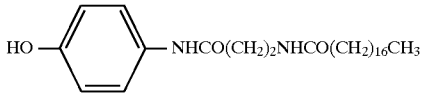
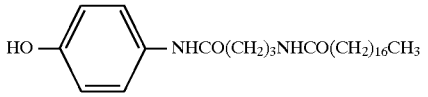
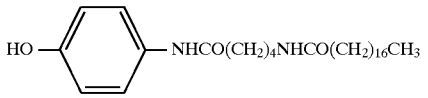
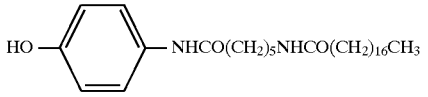
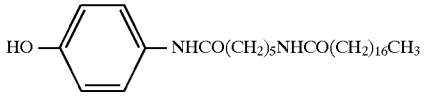
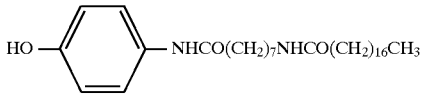
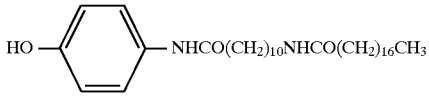
-continued
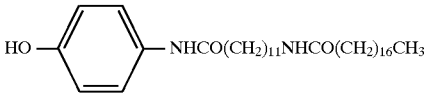
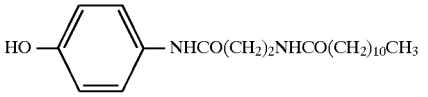
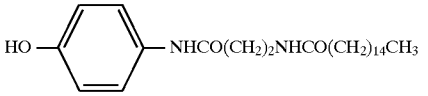
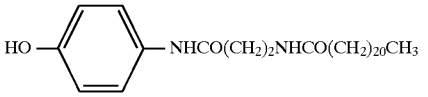
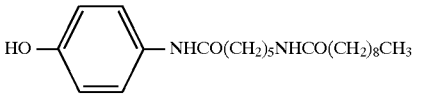
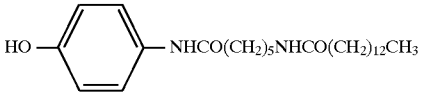
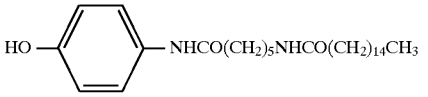
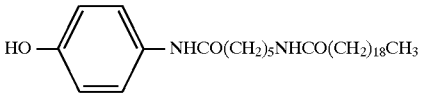
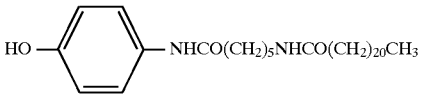
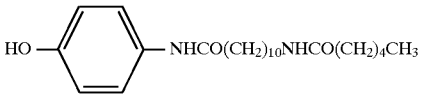
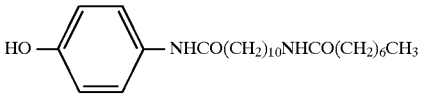
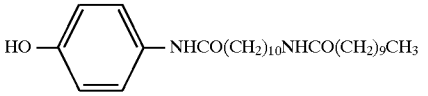
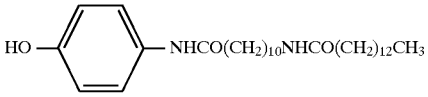
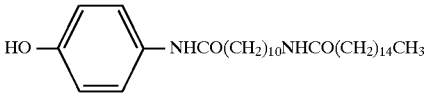
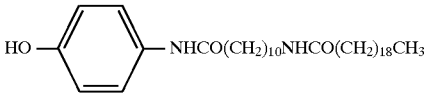

-continued
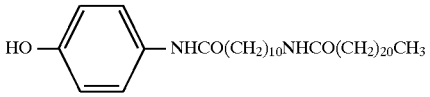
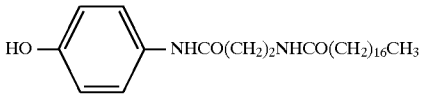
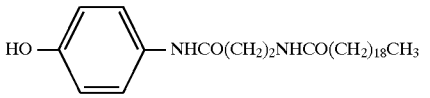
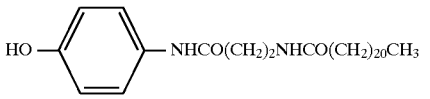
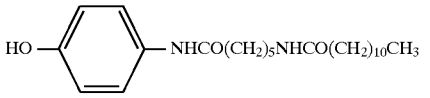
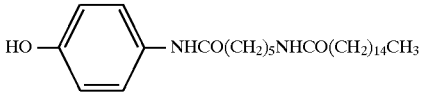
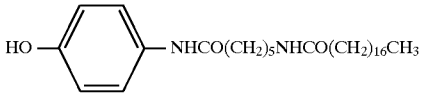
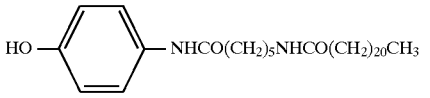
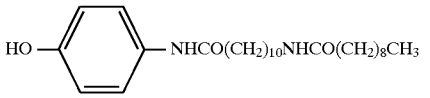
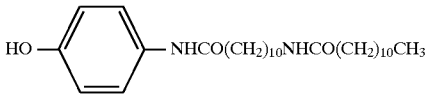
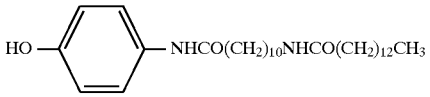
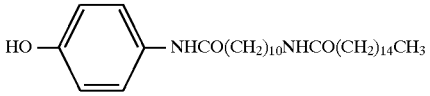
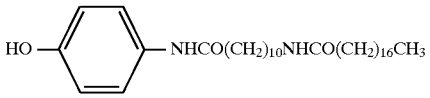
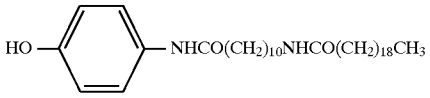
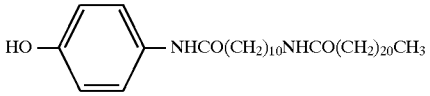
-continued
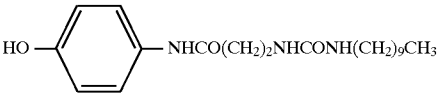
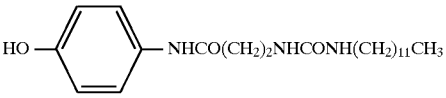
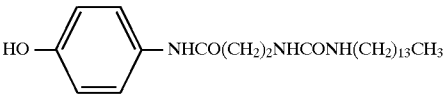
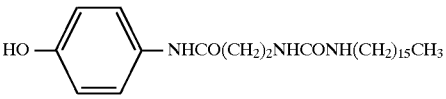
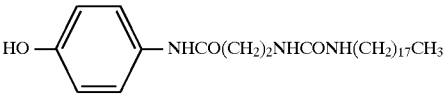
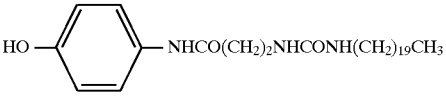
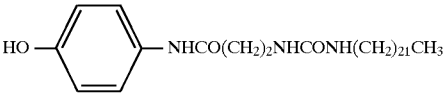
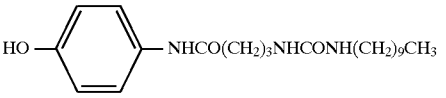
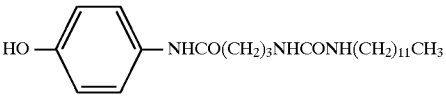
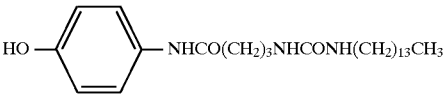
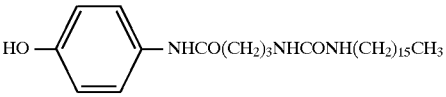
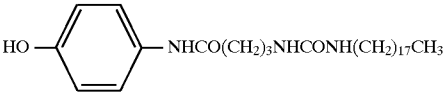
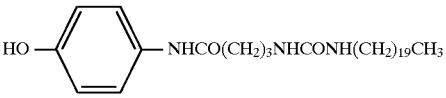
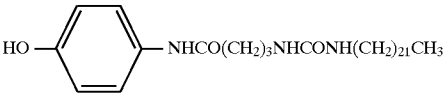
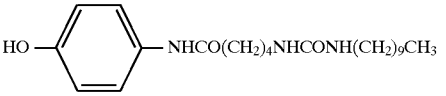

-continued
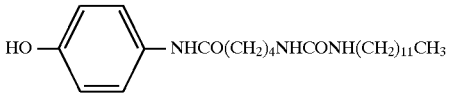
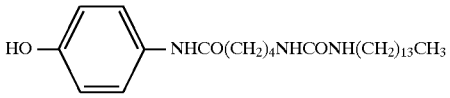
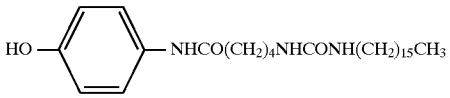
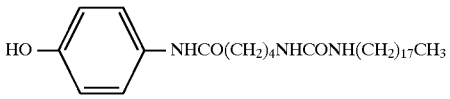
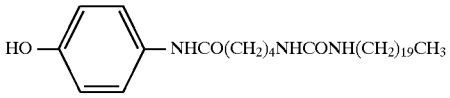
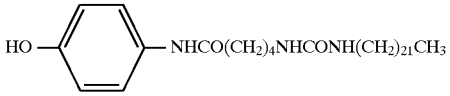
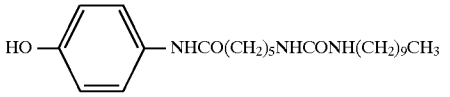
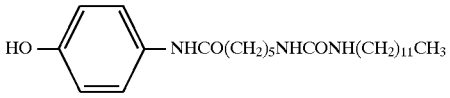
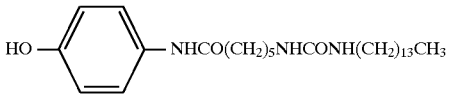
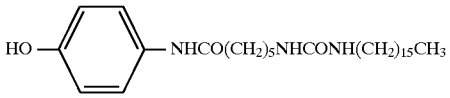
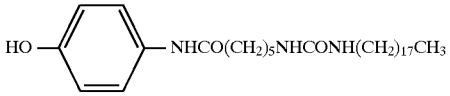
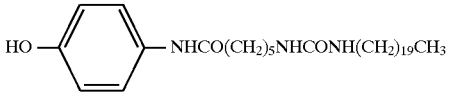
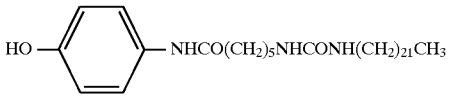
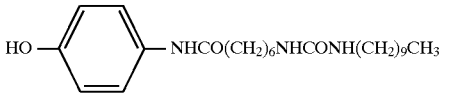
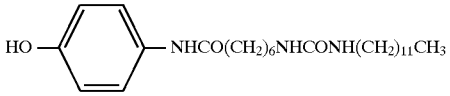
-continued
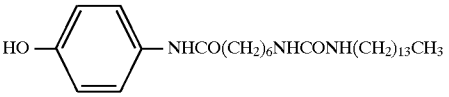
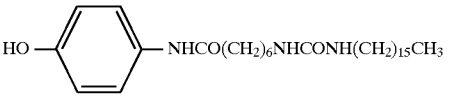
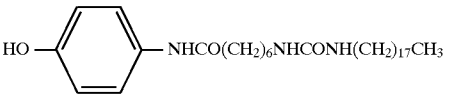
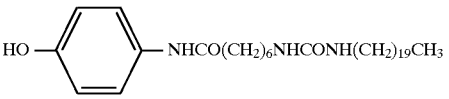
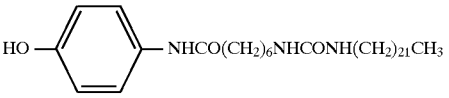
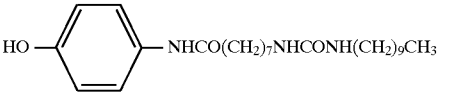
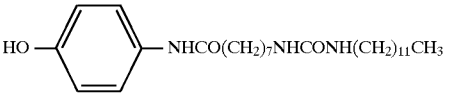
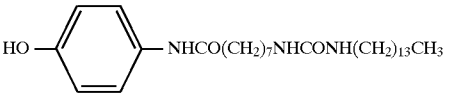
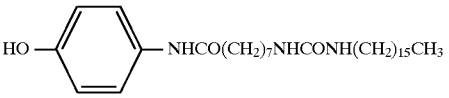
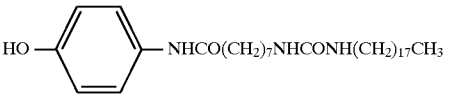
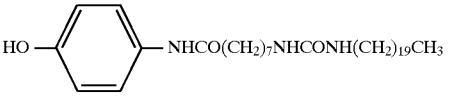
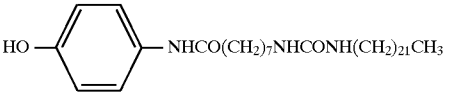
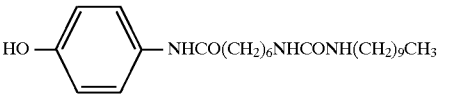
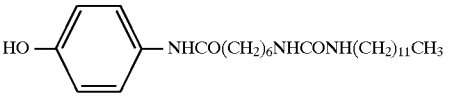
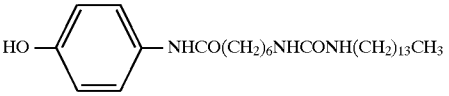

-continued

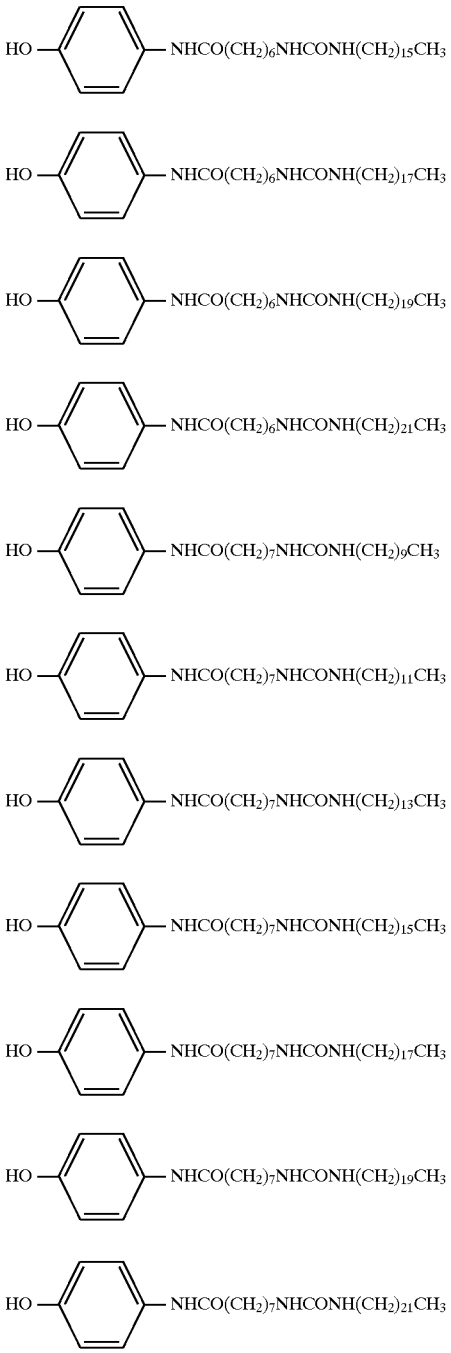

The coloring agent used in conjunction with the above developer is an electron donor compound capable of interacting with the developer when heated at an elevated temperature, thereby developing a color. Colorless or light colored dye precursors (leuco dyes) conventionally used in thermosensitive materials may be used as the coloring agent. Such leuco dyes may be, for example, phthalide compounds, azaphthalide compounds, fluoran compounds, phenothiazine compounds and leuco-auramine compounds. The coloring agent having the following general formula may be particularly suitably used.

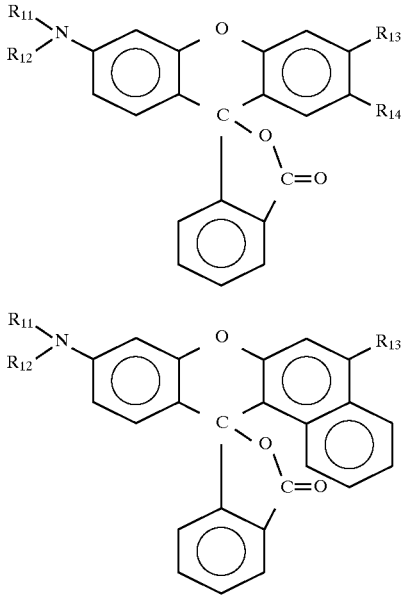

wherein $R^{11}$ stands for a hydrogen atom or an alkyl group having 1–4 carbon atoms, $R^{12}$ stands for an alkyl group having 1–6 carbon atoms, a cyclohexyl group or a substituted or unsubstituted phenyl group, $R^{13}$ stands for a hydrogen atom, an alkyl group having 1–2 carbon atoms, an alkoxy group or a halogen atom and $R^{14}$ stands for a hydrogen atom, a methyl group, a halogen atom or a substituted or unsubstituted amino group. Examples of the substituents of the phenyl group $R^{12}$ include an alkyl group such as a methyl group, an ethyl group or other lower alkyl group; an alkoxy group such as methoxy group or an ethoxy group; and a halogen atom. Examples of the substituents of the amino group $R^{14}$ include an alkyl group, a substituted or unsubstituted aryl group or a substituted or unsubstituted aralkyl group. Examples of the substituents of the aryl and aralkyl groups include an alkyl group, a halogen atom and an alkoxy group.

Illustrative of suitable coloring agents of the above formulas are as follows:

2-anilino-3-methyl-6-diethylaminofluoran,
2-anilino-3-methyl-6-(di-n-butylamino)fluoran,
2-anilino-3-methyl-6-(N-n-propyl-N-methylamino)fluoran,
2-anilino-3-methyl-6-(N-isopropyl-N-methylamino)fluoran,
2-anilino-3-methyl-6-(N-isobutyl-N-methylamino)fluoran,
2-anilino-3-methyl-6-(N-n-amyl-N-methylamino)fluoran,
2-anilino-3-methyl-6-(N-sec-butyl-N-ethylamino)fluoran,
2-anilino-3-methyl-6-(N-n-amyl-N-ethylamino)fluoran,
2-anilino-3-methyl-6-(N-isoamyl-N-ethylamino)fluoran,
2-anilino-3-methyl-6-(N-n-propyl-N-isopropylamino) fluoran,
2-anilino-3-methyl-6-(N-cyclohexyl-N-methylamino) fluoran,
2-anilino-3-methyl-6-(N-ethyl-p-toluidino)fluoran,
2-anilino-3-methyl-6-(N-methyl-p-toluidino) fluoran,
2-(m-trichloromethylanilino)-3-methyl-6-diethylaminofluoran,
2-(m-trifluoromethylanilino)-3-methyl-6-diethylaminofluoran,
2-(m-trifluoromethylanilino)-3-methyl-6-(N-cyclohexyl-N-methylamino) fluoran,
2-(2,4-di methylanilino)-3-methyl-6-diethylaminofluoran,
2-(N-ethyl-p-toluidino)-3-methyl-6-(N-ethylanilino) fluoran, 2-(N-methyl-p-toluidino)-3-methyl-6-(N-propyl-p-toluidino)fluoran,
2-anilino-6-(N-n-hexyl-N-ethylamino)fluoran,
2-(o-chloroanilino)-6-diethylaminofluoran,
2-(o-bromoanilino)-6-diethylaminofluoran,
2-(o-chloroanilino)-6-dibutylaminofluoran,
2-(o-bromoanilino)-6-dibutylaminofluoran,
2-(m-trifluoromethylanilino)-6-diethylaminofluoran,
2-(p-acetylanilino)-6-(N-n-amyl-N-n-butylamino)fluoran,
2-benzylamino-6-(N-ethyl-p-toluidino)fluoran,
2-benzylamino-6-(N-methyl-2,4-dimethylanilino)fluoran,
2-benzylamino-6-(N-ethyl-2,4-dimethylanilino)fluoran,
2-dibenzylamino-6-(N-methyl-p-toluidino)fluoran,
2-dibenzylamino-6-(N-ethyl-p-toluidino)fluoran,
2-(di-p-methylbenzylamino)-6-(N-ethyl-p-toluidino) fluoran,
2-(α-phenylethylamino)-6-(N-ethyl-p-toluidino)fluoran,
2-methylamino-6-(N-methylanilino)fluoran,
2-methylamino-6-(N-ethylanilino)fluoran,
2-methylamino-6-(N-propylanilino)fluoran,
2-ethylamino-6-(N-methyl-p-toluidino)fluoran,
2-methylamino-6-(N-methyl-2,4-dimethylanilino)fluoran,
2-ethylamino-6-(N-ethyl-2,4-dimethylanilino)fluoran,
2-dimethylamino-6-(N-methylanilino)fluoran,
2-dimethylamino-6-(N-ethylanilino)fluoran,
2-diethylamino-6-(N-methyl-p-toluidino)fluoran,
2-diethylamino-6-(N-ethyl-p-toluidino)fluoran,
2-dipropylamino-6-(N-methylanilino)fluoran,
2-dipropylamino-6-(N-ethylanilino)fluoran,
2-amino-6-(N-methylanilino)fluoran,
2-amino-6-(N-ethylanilino)fluoran,
2-amino-6-(N-propylanilino)fluoran,
2-amino-6-(N-methyl-p-toluidino) fluoran
2-amino-6-(N-ethyl-p-toluidino)fluoran,
2-amino-6-(N-propyl-p-toluidino)fluoran,
2-amino-6-(N-methyl-p-ethylanilino)fluoran,
2-amino-6-(N-ethyl-p-ethylanilino)fluoran,
2-amino-6-(N-propyl-p-ethylanilino)fluoran,
2-amino-6-(N-methyl-2,4-dimethylanilino)fluoran,
2-amino-6-(N-ethyl-2,4-dimethylanilino)fluoran,
2-amino-6-(N-propyl-2,4-dimethylanilino)fluoran,
2-amino-6-(N-methyl-p-chloroanilino)fluoran,
2-amino-6-(N-ethyl-p-chloroanilino)fluoran,
2-amino-6-(N-propyl-p-chloroanilino)fluoran,
2,3-dimethyl-6-dimethylaminofluoran,
3-methyl-6-(N-ethyl-p-toluidino)fluoran,
2-chloro-6-diethylaminofluoran,
2-bromo-6-diethylaminofluoran,
2-chloro-6-dipropylaminofluoran,
3-chloro-6-cyclohexylaminofluoran,
3-bromo-6-cyclohexylaminofluoran,
2-chloro-6-(N-ethyl-N-isoamylamino)fluoran,
2-chloro-3-methyl-6-diethylaminofluoran,
2-anilino-3-chloro-6-diethylaminofluoran,
2-(o-chloroanilino)-3-chloro-6-cyclohexylaminofluoran,
2-(m-trifluoromethylanilino)-3-chloro-6-diethylaminofluoran,
2-(2,3-dichloroanilino)-3-chloro-6-diethylaminofluoran,
1,2-benzo-6-diethylaminofluoran,
1,2-benzo-6-(N-ethyl-N-isoamylamino)fluoran,
1,2-benzo-6-dibutylaminofluoran,
1,2-benzo-6-(N-methyl-N-cyclohexylamino)fluoran and
1,2-benzo-6-(N-ethyltoluidino)fluoran.

The following coloring agents may also be suitably used for the purpose of the present invention:

2-anilino-3-methyl-6-(N-2-ethoxypropyl-N-ethylamino) fluoran,
2-(p-chloroanilino)-6-(N-n-octylamino)fluoran,
2-(p-chloroanilino)-6-(N-n-palmitylamino)fluoran,
2-(p-chloroanilino)-6-(di-n-octylamino)fluoran,
2-benzoylamino-6-(N-ethyl-p-toluidino)fluoran,
2-(o-methoxybenzoylamino)-6-(N-methyl-p-toluidino) fluoran,
2-dibenzylamino-4-methyl-6-diethylaminofluoran,
2-dibenzylamino-4-methoxy-6-(N-methyl-p-toluidino) fluoran,
2-dibenzylamino-4-methyl-6-(N-ethyl-p-toluidino)fluoran,
2-(α-phenylethylamino)-4-methyl-6-diethylaminofluoran,
2-(p-toluidino)-3-(t-butyl)-6-(N-methyl-p-toluidino)fluoran,
2-(o-methoxycarbonylanilino)-6-diethylaminofluoran,
2-acetylamino-6-(N-methyl-p-toluidino)fluoran,
3-diethylamino-6-(m-trifluoromethylanilino)fluoran,
4-methoxy-6-(N-ethyl-p-toluidino)fluoran,
2-ethoxyethylamino-3-chloro-6-dibutylaminofluoran,
2-dibenzylamino-4-chloro-6-(N-ethyl-p-toluidino)fluoran,
2-(α-phenylethylamino)-4-chloro-6-diethylaminofluoran,
2-(N-benzyl-p-trifluoromethylanilino)-4-chloro-6-diethylaminofluoran,
2-anilino-3-methyl-6-pyrolidinofluoran,
2-anilino-3-chloro-6-pyrolidinofluoran,
2-anilino-3-methyl-6-(N-ethyl-N-tetrahydrofurfurylamino) fluoran,
2-mesidino-4',5'-benzo-6-diethylaminofluoran,
2-(m-trifluoromethylanilino)-3-methyl-6-pyrolidinofluoran,
2-(α-naphthylamino)-3,4-benzo-4'-bromo-6-(N-benzyl-N-cyclohexylamino)fluoran,
2-piperidino-6-diethylaminofluoran,
2-(N-n-propyl-p-trifluoromethylanilino)-6-morpholinofluoran,
2-(di-N-p-chlorophenylmethylamino)-6-pyrolidinofluoran,
2-(N-n-propyl-m-trifluoromethylanilino)-6-morpholinofluoran,
1,2-benzo-6-(N-ethyl-N-n-octylamino)fluoran,
1,2-benzo-6-diallylaminofluoran,
1,2-benzo-6-(N-ethoxyethyl-N-ethylamino)fluoran, benzo-leuco methylene blue,
2-[3,6-bis(diethylamino)]-6-(o-chloroanilino)xanthyl benzoic acid lactam,
2-[3,6-bis(diethylamino)]-9-(o-chloroanilino)xanthyl benzoic acid lactam,
3,3-bis(p-dimethylaminophenyl)phthalide,
3,3-bis(p-dimethylaminophenyl)-6-dimethylaminophthalide,
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-(2-methoxy-4-dimethylaminophenyl)-3-(2-hydroxy-4,5-dichlorophenyl)phthalide,
3-(2-hydroxy-4-dimethylaminophenyl)-3-(2-methoxy-5-chlorophenyl)phthalide,
3-(2-hydroxy-4-dimethoxyaminophenyl)-3-(2-methoxy-5-chlorophenyl)phthalide,
3-(2-hydroxy-4-dimethylaminophenyl)-3-(2-methoxy-5-nitrophenyl)phthalide,
3-(2-hydroxy-4-diethylaminophenyl)-3-(2-methoxy-5-methylphenyl)phthalide,
3-(2-methoxy-4-dimethylaminophenyl)-3-(2-hydroxy-4-chloro-5-methoxyphenyl)phthalide,
3,6-bis(dimethylamino)fluorenespiro(9,3')-6'-dimethylaminophthalide,
3-(1-ethyl-2-methylindole-3-yl)-3-(2-ethoxy-4-diethylaminophenyl)-4-azaphthalide,
3-(1-octyl-2-methylindole-3-yl)-3-(2-ethoxy-4-diethylaminophenyl)-4-azaphthalide, 3-(1-ethyl-2-methylindole-3-yl)-3-(2-ethoxy-4-diethylaminophenyl)-7-azaphthalide,
3,3-bis(2-ethoxy-4-diethylaminophenyl)-4-azaphthalide,
3,3-bis(2-ethoxy-4-diethylaminophenyl)-7-azaphthalide,
6'-chloro-8'-methoxybenzoindolinospiropyran and
6'-bromo-2'-methoxybenzoindolinospiropyran.

In the thermosensitive recording layer, the molar ratio of the developer to the coloring agent is generally in the range from 0.1:1 to 20:1, preferably 0.2:1 to 10:1 for reasons of obtaining satisfactory image density in the color development state.

Preferably, the coloring agent and the developer are homogeneously dispersed in a matrix of a binder to form the recording layer. If desired, the coloring agent and the developer may be encapsulated in micro-capsules. The binder may be, for example, a polyvinyl chloride resin, a polyvinyl acetate resin, a vinyl chloride-vinyl acetate copolymer, ethylcellulose, a polystyrene resin, a styrene copolymer, a phenoxy resin, an aliphatic or aromatic polyester resin, a polyurethane resin, a polycarbonate resin, a poly(meth)acrylate resin, poly(meth)acrylic acid resin, a (meth)acrylic acid copolymer, a maleic acid copolymer, a polyvinyl alcohol resin, hydroxyethylcellulose, carboxymethylcellulose and starch. These binders may be used by themselves or as a mixture of two or more. The binder serves to maintain the coloring agent and the developer in a homogeneously dispersed state when the recording layer is heated for recording and erasing. Thus, it is preferred that the binder have a high resistance to heat. For this reason, the binder may be suitably cross-linked after the formation of the thermosensitive recording layer by irradiation with UV rays, an electron beam or by heating.

Such a heat-hardenable resin may be a combination of a cross-linking agent with a resin having an active group capable of reacting with the cross-linking agent and can be hardened by irradiation with UV rays, an electron beam or by heating.

The thermally hardenable resin may be, for example, a phenoxy resin, a polyvinyl butyral resin, cellulose acetate propionate, cellulose acetate butyrate, a resin having a group, such as a hydroxyl group or a carboxyl group, capable of reacting with a cross-linking agent or a copolymer of a monomer having a hydroxyl group or a carboxyl group with another copolymerizable monomer. Examples of such copolymers include vinyl chloride resins such as vinyl chloride-vinyl acetate-vinyl alcohol copolymers, vinyl chloride-vinyl acetate-hydroxypropyl acrylate copolymers and vinyl chloride-vinyl acetate-maleic anhydride copolymers, acrylic copolymers and styrene copolymers. Illustrative of suitable cross-linking agents are isocyanates, amino resins, phenol resins, amines and epoxy compounds. The isocyanate may be a polyisocyanate compound having a plurality of isocyanate groups, such as hexamethylenediisocyanate, toluenediisocyanate, xylylenediisocyanate, an adduct thereof with, for example, trimethylolpropane, a buret thereof, an isocyanurate thereof and a block isocyanate thereof. The cross-linking agent is used in an amount of 0.01 to 2 equivalents (in terms of the functional group of the cross-linking agent) per equivalent of the active groups contained in the hardenable resin. If desired, a conventionally employed accelerator or catalyst, such as a tertiary amine (e.g. 1,4-diaza-bicyclo[2,2,2]octane) or a metal compound (e.g. an organic tin compound), may be used.

UV- or electron beam-hardenable monomers may be (a) monofunctional monomers such as methyl methacrylate, ethyl methacrylate, n-butyl methacrylate, i-butyl methacrylate, t-butyl methacrylate, 2-ethylhexyl methacrylate, lauryl methacrylate, tridecyl methacrylate, stearyl methacrylate, cyclohexyl methacrylate, benzyl methacrylate, methacrylic acid, 2-hydroxyethyl methacrylate, 2-hydroxypropyl methacrylate, dimethylaminoethyl methacrylate, dimethylaminoethyl methacrylate methylchloride, diethylaminoethyl methacrylate, glycidyl methacrylate, tetrahydrofurfuryl methacrylate, allyl metharylate, ethylene glycol dimethacrylate, triethylene glycol dimethacrylate, tetraethylene glycol dimethacrylate, 1,3-butylene glycol dimethacrylate, 1,6-hexanediol dimethacrylate, trimethylolpropane trimethacrylate, 2-ethoxyethyl methacrylate, 2-ethylhexyl acrylate, 2-ethoxyethyl acrylate, 2-ethoxyethoxyethyl acrylate, 2-hydroxyethyl acrylate, 2-hydroxypropyl acrylate, dicylopentenylethyl acrylate, N-vinylpyrrolidone and vinyl acetate;

(b) difunctional monomers such as 1,4-butanediol diacrylate, 1,6-hexanediol diacrylate, 1,9-nonanediol diacrylate, neopentyl glycol diacrylate, tetraethylene glycol diacrylate, tripropylene glycol diacrylate, polypropylene glycol diacrylate, diacrylate of bisphenol A ethylene oxide adduct, glycerin methacrylate acrylate, diacrylate of neopentyl glycol propylene oxide (2 mols) adduct, diethylene glycol diacrylate, polyethylene glycol(400) diacrylate, diacrylate of hydroxypyvalic acid ester of neopentyl glycol, 2,2-bis(4-acryloxydiethoxyphenyl) propane, diacrylate of neopentyl glycol diadipate, diacrylate of a ϵ-caprolactone adduct of neopentyl glycol ester of hydroxypyvalic acid, 2-(2-hydroxy-1,1-dimethylethyl) -5-hydroxymethyl-5-ethyl-1,3-di oxane diacrylate, tricyclodecanedimethylol diacrylate, a ϵ-caprolactone adduct of tricyclodecane-dimethylol diacrylate and diacrylate of 1,6-hexane diol glycidyl ether; and (c) polyfunctional monomers such as trimethylolpropane triacrylate, acrylate of propylene oxide adduct of glycerin, trisacryloyloxyethyl phosphate, pentaerythritol acrylate, triacrylate of propylene oxide (3 mols) adduct of trimethylol propane, dipentaerythritol polyacrylate, polyacrylate of caprolactone adduct of dipentaerythritol, triacrylate of dipethaerythritol propionate, hydroxypivaldehyde-modified dimethylolpropane triacrylate, tetracrylate of dipentaerythritol propionate, ditrimethylolpropane tetracrylate, pentacrylate of dipentaerythritol propionate, dipentaerythritol hexacrylate, and ϵ-caprolactone adduct of dipentaerythritol hexacrylate. Oligomers such as diepoxy acrylate adduct of bisphenol A may also be used.

A photopolymerization initiator may be suitably used for the cross-linking by UV irradiation. Illustrative of suitable initiators are benzoin ethers such as isobutyl benzoin ether, isopropyl benzoin ether, benzoin ethyl ether and benzoin methyl ether; α-acyloxime esters such as 1-phenyl-1,2-propanedione-2-(o-ethoxycarbonyl)oxime; benzyl ketals such as 2,2-dimethoxy-2-phenylacetophenone dibenzyl and hydroxycylohexyl phenyl ketone benzyl; acetophenones such as diethoxyacetophenone, 2-hydroxy-2-methyl-1-phenylpropane-1-one; and ketones such as benzophenone, 1-chlorothioxanthone, 2-chlorothioxanthone, isopropylthioxanthone, 2-methylthioxanthone and 2-chlorobenzophenone. These initiators may be used singly or in combination of two or more thereof. The initiator is generally used in an amount of 0.005 to 1 part by weight, preferably 0.01 to 0.5 part by weight, per part by weight of the monomer or oligomer.

A polymerization accelerator such as an aromatic tertiary amine or an aliphatic amine may also be suitably used. Examples of accelerators include isoamyl p-dimethylaminobenzoate and ethyl p-dimethylaminobezoate. These accelerators may be used singly or in combination of two or more thereof. The accelerator is generally used in an amount of 0.1–5 parts by weight, preferably 0.3–3 parts by weight, per part by weight of the polymerization initiator.

The UV irradiation may be performed using, for example, a mercury lamp, metal halide lamp, a gallium lamp, mercury xenon lamp or flush lamp. Suitable UV source is suitably selected in view of the absorption wavelength of the polymerization initiator and accelerator. The irradiation conditions such as lamp output power, scanning speed, irradiation area and dose rate are suitably determined to effect the cross-linking in an optimum manner.

Various kinds of additives which are customarily employed in conventional thermosensitive recording materials may be also incorporated into the recording layer to improve the coating properties and to upgrade the recording characteristics as necessary. Such additives may include a dispersant, a surface active agent, an electroconductivity imparting agent, a filler, a colored image stabilizer, an antioxidant, a light stabilizer, a UV absorbing agent, a decolorization accelerating agent and a lubricant.

The thermosensitive recording layer is preferably formed on the support by first compositing the coloring agent and the developer. This may be carried out by dissolving the two ingredients in a suitable solvent and drying the solution or by fusing the two ingredients together and solidifying the fused mass. A coating liquid containing the composited coloring agent and the developer is then prepared using a suitable solvent or dispersing medium and the solution or dispersion is applied onto the support by any known coating method to form the recording layer.

In addition to the thermosensitive recording layer, the thermosensitive recording medium according to the present invention may includes a protecting layer, an adhesive layer, an intermediate layer, an undercoat layer and/or a backcoat layer.

The protecting layer is provided on the thermosensitive recording layer for improving the durability thereof. The protecting layer also serves to prevent the deformation or color change of the surface of the recording medium by heat and pressure applied thereto during recording with a thermal head. Polyvinyl alcohol, a styrene-maleic anhydride copolymer, carboxy-modified polyethylene, a melamine-formaldehyde resin, a urea-formaldehyde resin or other UV- or electron beam-hardenable resins may be suitably used for the formation of the protecting layer. An additive such as a UV absorbing agent may be incorporated into the protecting layer.

The intermediate layer is provided between the protecting layer and the thermosensitive recording layer for improving the adhesion therebetween, for preventing deterioration of the recording layer by interaction with the protecting layer. The undercoat layer is provided between the support and the thermosensitive recording layer for improving the heat insulating properties and thereby enhancing the effective utilization of the heat applied to the recording medium during recording and erasing. The undercoat layer also serves to prevent the penetration of a coating liquid of the thermosensitive recording layer during fabrication of the recording medium.

The above-described binder resin for the recording layer may be suitably used for the formation of the intermediate and undercoat layers.

A filler such as calcium carbonate, magnesium carbonate, titanium oxide, silicon oxide, aluminum hydroxide, kaolin or talc, a lubricant and/or a surfactant may be suitably incorporated into the protecting layer, intermediate layer and/or undercoat layer.

If desired, the thermosensitive recording medium may further includes another recording layer such as a magnetic recording layer or an ordinary irreversible thermosensitive layer. Such an additional recording layer may be formed on the support. Further, one or more colored layers can be formed on a part of or on entire surface of the thermosensitive recording medium. Such colored layer or layers may be overlaid with the above-described protecting layer. In this case, the protecting layer can cover the entire surface of the recording medium or can only cover the colored layer or layers. The colored layers and the protecting layer can improve the durability (service life and resistance to repeated use), transferability, resistance to deposition of fouls, dirts and finger prints and ability to prevent the deposition of dirts on the thermal printer.

The thermosensitive recording layer can assume a color development state and a decolorization state depending upon the thermal hysteresis thereof, namely depending upon the temperature at which the recording layer is heated and/or the rate at which the recording layer is cooled.

The mechanism of reversible color development and decolorization will be described in more detail with reference to FIG. 1. The recording layer in a low temperature decolorization state A is colored to assume a high temperature color development state B when heated at a temperature higher than $T_1$ at which the layer is fused, as shown by the solid line. The colored layer retains the color development state when rapidly cooled to room temperature and assumes a low temperature color development state C. When gradually cooled, however, the layer returns to the low temperature decolorization state A as shown by the dotted line or to a state where the image density is considerably lower than that of the color development state C. When the layer in the low temperature color development state C is heated, decolorization occurs at a temperature $T_2$ as shown by the broken line. The layer thus assumes a high temperature decolorization state D at a temperature below $T_1$. The layer in the state D, when cooled to room temperature, returns to the low temperature decolorization state A.

The tempeatures at which the color development and discoloration occur vary depending upon the kinds of the coloring agent and the developer. Suitable combination of the coloring agent and developer is determined according to the end use of the recording medium. The color density in the high temperature color development state B and that in the low temperature color development state C are not always the same and, rather, are generally different from each other. For example, there is a case in which the color density in the high temperature color development state B is very low but the color density greatly increases as the recording layer is rapidly cooled so that a stable colored state C is obtainable at room temperature. Such a recording medium, of course, falls within the scope of the present invention.

In the low temperature color development state C, the coloring agent and the developer are considered to form aggregates in which the coloring agent molecules are in contact with the developer molecules. The formation of aggregates accounts for the stable color development state. In the decolorization state, the aggregates are destroyed and the developer phase is separated from the coloring agent phase by, for example, crystallization of the developer. The completely discolored state is obtained when both the coloring agent and the developer are crystallized and separated from each other. The "rapid cooling" required for changing the state B to state C and the "gradual cooling" required for changing the state B to state A are relative terms, i.e. the cooling rate varies depending upon the kind of the thermosensitive coloring composition (thermosensitive recording layer) and cannot be specifically defined.

The image formation may be suitably carried out by heating the recording layer at above $T_1$ with, for example, a thermal head or a laser beam for a short period of time. Since the temperature increases locally, the heated area is rapidly cooled as a result of the diffusion of the heat as soon as the heating is stopped. Thus, by heating the thermosensitive recording layer imagewise, a desired pattern may be formed. To erase the image, on the other hand, the thermosensitive layer is either heated at above $T_1$ or between $T_2$ and $T_1$ for a long period of time with a thermal head and then allowed to cool to room temperature or heated for a short period of time at a temperature between $T_2$ and $T_1$. In the former case, since the recording medium as a whole is heated by the long period heating, the recording layer is gradually cooled, so that the erasure takes place. A heat roller, a heat stamp, hot air or a thermal head may be used for the former case of erasure. In the latter case, a thermal head, a heat roller or a heat stamp may be used. By controlling the energy applied to a thermal head by the adjustment of the impressed voltage and/or pulse, the thermosensitive recording layer can be heated with a single thermal head to temperatures suitable for color development and for decolorization. In this case, it is possible to perform overwriting.

The following examples will further illustrate the present invention. Parts and Percentages are by weight.

EXAMPLE 1

A mixture of 2-anilino-3-methyl-6-dibutylaminofluoran and each of Developers No. 1 to No. 14 shown in Table 1 below (molar ratio of the fluoran to the developer: 1:1) was pulverized in a mortar. A glass plate with a thickness of 1.2 mm was heated at 210° C. with a hot plate and the above pulverized mixture was placed on the heated glass plate. As a result, the mixture was fused. A cover glass was then placed on the fused mixture to spread same into a uniform thickness. The spread mixture on the glass plate was immersed in ice water to solidify the mixture and to obtain a colored thin film of each of the thermosensitive coloring compositions.

When each colored film was placed on a hot plate at 110° C., decolorization occurred instantaneously. When the decolorized sample was heated to 210° C., the sample was fused and turned black. Thus, it was revealed that each of the above compositions was capable of reversibly assume the colored and decolorized states.

TABLE 1

| Developer No. | Chemical Structure |
|---|---|
| 1 | 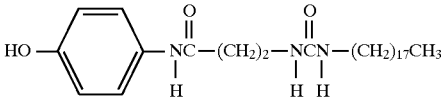 |
| 2 | 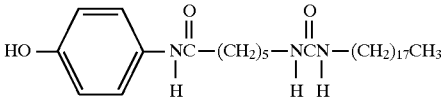 |

TABLE 1-continued

| Developer No. | Chemical Structure |
|---|---|
| 3 | 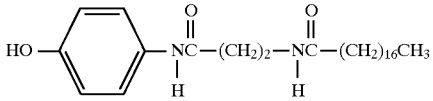 |
| 4 | 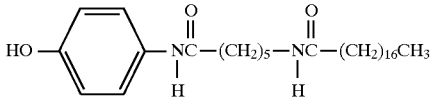 |
| 5 | 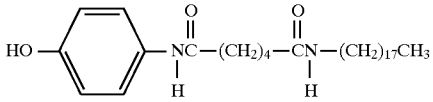 |
| 6 | 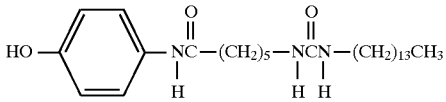 |
| 7 | 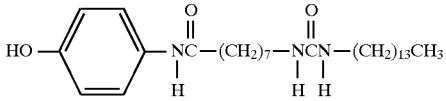 |
| 8 | 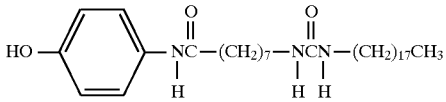 |
| 9 | 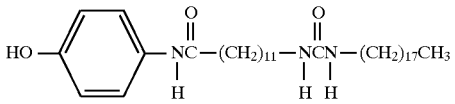 |
| 10 | 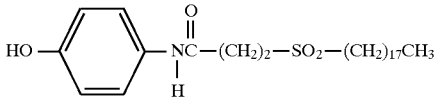 |
| 11 | 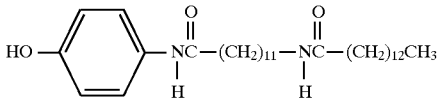 |
| 12 | 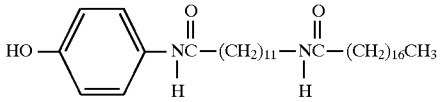 |
| 13 | 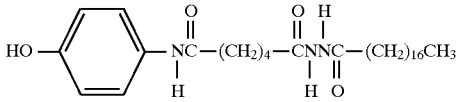 |
| 14 | 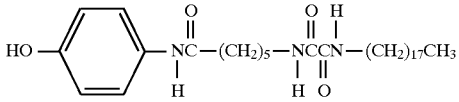 |

EXAMPLE 2

The following components were placed in a ball mill and ground to a particle size of 1–4 μm and to obtain a coating liquid in the form of a dispersion.

| | |
|---|---|
| 2-anilino-3-methyl-6-dibutylaminofluoran | 2 parts |
| Developer No. 1 to No. 14 shown in Table 1 | 8 parts |
| Vinyl chloride-vinyl acetate copolymer (VYHH manufactured by Union Carbide Inc.) | 20 parts |
| Methyl ethyl ketone | 45 parts |
| Toluene | 45 parts |

Each of the coating liquids was then applied on a polyester film with a thickness of 100 μm by a wire bar and the coating was dried to obtain a thermosensitive recording medium having a thermosensitive recording layer with a thickness of about 6.0 μm provided on the polyester film.

Each of the thermosensitive recording media thus obtained was tested for the image density upon development and erasure. Thus, the sample was recorded with a thermal head of 8 dots/mm at an applied voltage of 13.3 V and a pulse width of 1.2 msec. The image density in the color development state was measured with McBeath densitometer RD-914. The sample was then heated with a hot stamp at an erasure temperature shown in Table 2 and maintained at that temperature for 0.2, 0.5 and 1 second to erase the developed image. The image density in the decolorization state was measured with McBeath densitometer RD-914. The results are summarized in Table 2. From the results shown in Table 2, it is appreciated that the recording media of the present invention can be discolored to a level comparable to the background by 0.2–0.5 second heating.

The above recording operation and erasure operation (heating time: 1 second) were repeated 10 times and the image densities in the color development state and in the decolorization state were measured. It was found that all of the recording media of the present invention were able to reversibly and repeatedly assume the color development and decolorization states in a stable manner.

Each of the colored recording media obtained above was maintained at 40° C. for 24 hours. The color densities of the background and the image before and after the test were measured to evaluate the storage stability. Storage stability (%) represents the ability to retain the image density and is defined as follows:

$$SS=(ID-BG)/(ID'-BG')\times 100$$

wherein SS represents the storage stability, ID represents the image density after the test, BG represents the color density of the background after the test, ID' represents the image density before the test, BG' represents the color density of the background before the test. The results are also summarized in Table 2. It is evident from the results of Table 2 that the recording media of the present invention have excellent storage stability.

COMPARATIVE EXAMPLE 1

Example 2 was repeated in the same manner as described except that eicosylsulfonic acid (Developer No. Comp.1) was used as the developer and that 2-anilino-3-methyl-6-(N-ethyl-N-p-tolylamino)fluoran was used as the coloring agent. The thus obtained recording medium was tested in the same manner as that in Example 2 to give the results shown in Table 2. As will be appreciated from Table 2, one second heating fails to completely discolor the image to the initial background level, i.e. the image remains unerased. It took 1 minute to reduce the color density of the image to 0.16. The storage stability is also not satisfactory.

COMPARATIVE EXAMPLE 2

Example 2 was repeated in the same manner as described except that a phenol compound (Developer No. Comp.2) of the formula:

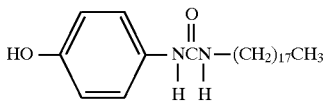

was used as the developer. The thus obtained recording medium was tested in the same manner as that in Example 2 to give the results shown in Table 2. As will be appreciated from Table 2, 0.2 second heating fails to completely discolor the image to the initial background level, i.e. the image remains unerased. It took 0.5–1 second to reduce the color density of the image to the background level. The storage stability is also not satisfactory.

COMPARATIVE EXAMPLE 3

Example 2 was repeated in the same manner as described except that a phenol compound (Developer No. Comp.3) of the formula:

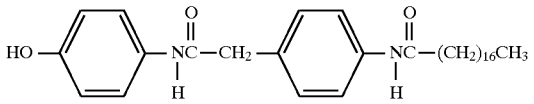

was used as the developer. The thus obtained recording medium was tested in the same manner as that in Example 2 to give the results shown in Table 2. As will be appreciated from Table 2, 0.2 second heating fails to completely discolor the image to the initial background level, i.e. the image remains unerased. It took 0.5–1 second to reduce the color density of the image to the background level. The storage stability is also not satisfactory.

TABLE 2

| | | | Initial | | | | After 10 times | | |
|---|---|---|---|---|---|---|---|---|---|
| Developer | Erasing Temperature | Initial BG Density | I.D. | Erased I.D. 0.2 sec | Erased I.D. 0.5 sec | Erased I.D. 1 sec | I.D. | Erased I.D. 1 sec | Storage Stability (%) |
| Ex. 2-No. 1 | 150° C. | 0.09 | 0.86 | 0.10 | 0.10 | 0.09 | 0.85 | 0.10 | 87 |
| Ex. 2-No. 2 | 150° C. | 0.10 | 0.84 | 0.10 | 0.10 | 0.10 | 0.83 | 0.10 | 85 |
| Ex. 2-No. 3 | 150° C. | 0.11 | 0.83 | 0.12 | 0.11 | 0.11 | 0.82 | 0.11 | 80 |
| Ex. 2-No. 4 | 150° C. | 0.10 | 0.82 | 0.12 | 0.11 | 0.10 | 0.81 | 0.11 | 77 |
| Ex. 2-No. 5 | 150° C. | 0.10 | 0.83 | 0.12 | 0.11 | 0.11 | 0.82 | 0.11 | 73 |
| Ex. 2-No. 6 | 170° C. | 0.09 | 0.79 | 0.10 | 0.09 | 0.09 | 0.81 | 0.10 | 82 |

TABLE 2-continued

| Developer | Erasing Temperature | Initial BG Density | Initial I.D. | Initial Erased I.D. 0.2 sec | Initial Erased I.D. 0.5 sec | Initial Erased I.D. 1 sec | After 10 times I.D. | After 10 times Erased I.D. 1 sec | Storage Stability (%) |
|---|---|---|---|---|---|---|---|---|---|
| Ex. 2-No. 7 | 150° C. | 0.12 | 0.80 | 0.13 | 0.12 | 0.12 | 0.81 | 0.11 | 70 |
| Ex. 2-No. 8 | 160° C. | 0.09 | 0.82 | 0.10 | 0.10 | 0.09 | 0.81 | 0.10 | 95 |
| Ex. 2-No. 9 | 140° C. | 0.10 | 0.81 | 0.11 | 0.10 | 0.10 | 0.80 | 0.10 | 87 |
| Ex. 2-No. 10 | 150° C. | 0.10 | 0.79 | 0.11 | 0.11 | 0.10 | 0.80 | 0.11 | 96 |
| Ex. 2-No. 11 | 140° C. | 0.10 | 0.81 | 0.12 | 0.11 | 0.10 | 0.81 | 0.10 | 100 |
| Ex. 2-No. 12 | 140° C. | 0.09 | 0.80 | 0.11 | 0.10 | 0.10 | 0.79 | 0.11 | 89 |
| Ex. 2-No. 13 | 170° C. | 0.09 | 0.78 | 0.11 | 0.10 | 0.10 | 0.79 | 0.10 | 100 |
| Ex. 2-No. 14 | 160° C. | 0.10 | 0.83 | 0.11 | 0.10 | 0.10 | 0.82 | 0.10 | 100 |
| Comp. Ex. 1 | 80° C. | 0.15 | 1.10 | 0.97 | 0.85 | 0.45 | 1.08 | 0.48 | 68 |
| Comp. Ex. 2 | 120° C. | 0.09 | 0.95 | 0.16 | 0.12 | 0.10 | 0.93 | 0.11 | 57 |
| Comp. Ex. 3 | 150° C. | 0.13 | 0.67 | 0.23 | 0.19 | 0.15 | 0.64 | 0.16 | 35 |

EXAMPLE 3

The following components were placed in a ball mill and ground to a particle size of 1–4 μm and to obtain a dispersion.

| | |
|---|---|
| 2-anilino-3-methyl-6-diethylaminofluoran | 2 parts |
| Developer No. 1 | 8 parts |
| 15% solution of polyester polyol (TAKELAC U-21 manufactured by Takeda Corporation) in tetrahydrofuran | 150 parts |

The dispersion was mixed with a 75% solution of adduct-type hexamethylenediamine diisocyanatein ethyl acetate (CORONATE HL manufactured by Nippon Polyurethane Inc.). The resulting coating liquid was then applied on a polyester film with a thickness of 100 μm by a wire bar and the coating was dried at 80° C. and heated at 60° C. for 24 hours to form a thermosensitive recording layer with a thickness of about 6.0 μm provided on the polyester film. An intermediate layer forming liquid having the following composition was prepared.

| | |
|---|---|
| 10% solution of polyester polyol in methyl ethyl ketone | 100 parts |
| Fine particulate silicon nitride (average diameter: 70 nm) | 10 parts |
| CORONATE HL | 15 parts |

The above liquid was applied onto the above thermosensitive recording layer with a wire bar and the coating was dried at 80° C. and heated at 60° C. for 24 hours to obtain an intermediate layer with a thickness of about 2 μm. A protecting layer forming liquid having the following composition was prepared.

| | |
|---|---|
| UV hardenable urethane acrylate resin (C7-157 manufactured by Dai-Nippon Ink) | 10 parts |
| Silica (P-527 manufactured by Mizusawa Chemical Inc.) | 0.1 part |
| Ethyl acetate | 90 parts |

The above liquid was applied onto the above intermediate layer with a wire bar and the coating was irradiated with UV rays by being passed beneath a UV lamp (80 W/cm) at a rate of 9 m/minute to obtain a hardened protecting layer.

The thus obtained recording medium was recorded with a thermal head of 8 dots/mm at an applied voltage of 13.3 V and a pulse width of 1.2 msec. The measurement with McBeath densitometer RD-914 revealed that the image density was 1.16 and the background density was 0.10. The sample was then heated with a hot stamp at an erasure temperature of 150° C. and maintained at that temperature for 0.5 second to erase the developed image. The image density in the decolorization state was 0.10. Such recording and erasure were repeated 50 times. However, no decrease in the image density and no increase in the background density were observed. The recorded medium was irradiated with light of a 5500 lux fluorescent lamp for 100 hours. However, no discoloration of the image, no coloring of the background and no erasure failure were observed.

EXAMPLE 4

A thermosensitive recording layer was formed in the same manner as described in Example 3 except that the following composition was used as the dispersion:

| | |
|---|---|
| 3-(4-diethylamino-2-ethoxyphenyl)-3-(1-ethyl-2-methylindol-3-yl)-4-azaphthalide | 2 parts |
| Developer No. 7 | 8 parts |
| N,N'-dioctadecylurea | 0.4 part |
| 15% solution of polyester polyol (TAKELAC U-21 manufactured by Takeda Corporation) in tetrahydrofuran | 150 parts |

The thus obtained recording layer was then overlaid with an intermediate layer using a coating liquid which was the same as that used in Example 3 except that the fine particulate silicon nitride was not used at all. Then, a protecting layer was formed on the intermediate layer in the same manner as that in Example 3 except that the protecting layer forming liquid had the following composition:

| | |
|---|---|
| UV hardenable urethane acrylate resin (C7-157 manufactured by Dai-Nippon Ink) | 10 parts |
| UV absorbing compound having the structure shown below | 0.5 part |
| Ethyl acetate | 90 parts |

-continued

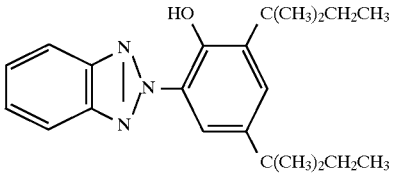

The resulting protecting layer was printed with OP vanish (New Dycure OL OP Vanish manufactured by Dai-Nippon Ink Corp.) and then irradiated with UV rays to form an OP layer having a thickness of 1.5 μm.

The thus obtained recording medium was recorded in the same manner as described in Example 3. The measurement with McBeath densitometer RD-914 revealed that the image density was 0.88 and the background density was 0.09. The sample was then heated with a hot stamp at an erasure temperature of 150° C. and maintained at that temperature for 0.5 second to erase the developed image. The image density in the decolorization state was 0.09. Such recording and erasure were repeated 50 times. However, no decrease in the image density and no increase in the background density were observed. The recorded medium was irradiated with light of a 5500 lux fluorescent lamp for 100 hours. However, no discoloration of the image, no coloring of the background and no erasure failure were observed.

EXAMPLE 5

A thermosensitive recording layer was formed in the same manner as described in Example 3 except that the following composition was used as the dispersion and the dispersion was mixed with 10 parts of CORONATE:

| | |
|---|---|
| 2-anilino-3-methyl-6-diethylaminofluoran | 2 parts |
| Developer No. 2 | 8 parts |
| 15% solution of acryl polyol (LR286 manufactured by Mitsubishi Rayon Inc.) in tetrahydrofuran | 150 parts |

The thus obtained recording layer was then overlaid with an intermediate layer in the same manner as that in Example 3 except that a coating liquid having the following composition was used:

| | |
|---|---|
| 10% solution of acryl polyol (LR286 manufactured by Mitsubishi Rayon Inc.) in methyl ethyl ketone | 100 parts |
| Finely divided zinc oxide (average particle diameter: 20 nm) | 10 parts |
| CORONATE HL | 5 parts |

Then, a protecting layer was formed on the intermediate layer in the same manner as that in Example 3 except that the protecting layer forming liquid had the following composition and that an OP layer was formed on the protecting layer in the same manner as that in Example 4.

| | |
|---|---|
| UV hardenable urethane acrylate resin (C7-157 manufactured by Dai-Nippon Ink) | 10 parts |
| Ethyl acetate | 90 parts |

The thus obtained recording medium was recorded in the same manner as described in Example 3. The measurement with McBeath densitometer RD-914 revealed that the image density was 1.21 and the background density was 0.09. The sample was then heated with a hot stamp at an erasure temperature of 150° C. and maintained at that temperature for 0.5 second to erase the developed image. The image density in the decolorization state was 0.09. Such recording and erasure were repeated 50 times. However, no decrease in the image density and no increase in the background density were observed. The recorded medium was irradiated with light of a 5500 lux fluorescent lamp for 100 hours. However, no discoloration of the image, no coloring of the background and no erasure failure were observed.

EXAMPLE 6

Example 4 was repeated in the same manner as described except that N,N'-dioctadecylurea was not used in the dispersion for the preparation of the thermosensitive recording layer.

The thus obtained recording medium was recorded in the same manner as described in Example 3. The measurement with McBeath densitometer RD-914 revealed that the image density was 0.91 and the background density was 0.10. The sample was then heated with a hot stamp at an erasure temperature of 150° C. and maintained at that temperature for 0.5 second to erase the developed image. The image density in the decolorization state was 0.10. Such recording and erasure were repeated 50 times. However, no decrease in the image density and no increase in the background density were observed. The recorded medium was irradiated with light of a 5500 lux fluorescent lamp for 100 hours. However, no discoloration of the image, no coloring of the background and no erasure failure were observed.

EXAMPLE 7

A thermosensitive recording layer was formed in the same manner as that in Example 6 and an intermediate layer was formed thereon in the same manner as that in Example 3. Thereafter, an OP layer was formed on the intermediate layer in the same manner as that in Example 4 to obtain a recording medium.

The thus obtained recording medium was recorded in the same manner as described in Example 3. The measurement with McBeath densitometer RD-914 revealed that the image density was 0.89 and the background density was 0.09. The sample was then heated with a hot stamp at an erasure temperature of 150° C. and maintained at that temperature for 0.5 second to erase the developed image. The image density in the decolorization state was 0.09. Such recording and erasure were repeated 50 times. However, no decrease in the image density and no increase in the background density were observed. The recorded medium was irradiated with light of a 5500 lux fluorescent lamp for 100 hours. However, no discoloration of the image, no coloring of the background and no erasure failure were observed.

EXAMPLE 8

A thermosensitive recording layer was formed in the same manner as that in Example 6 and an intermediate forming liquid having the following composition was applied thereon and dried at 80° C. and heated at 60° C. for 24 hours to form an intermediate layer having a thickness of about 2 μm.

| | |
|---|---|
| 15% solution of polyester polyol (TAKELAC U-21 manufactured by Takeda Corporation) in tetrahydrofuran | 100 parts |
| UV absorbing compound having the structure show below | 10 parts |
| CORONATE HL | 15 parts |

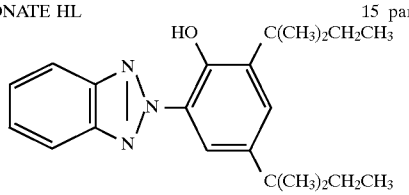

On the intermediate layer was then formed an OP layer in the same manner as that in Example 4 to obtain a thermosensitive recording medium.

The thus obtained recording medium was recorded in the same manner as described in Example 3. The measurement with McBeath densitometer RD-914 revealed that the image density was 0.90 and the background density was 0.09. The sample was then heated with a hot stamp at an erasure temperature of 150° C. and maintained at that temperature for 0.5 second to erase the developed image. The image density in the decolorization state was 0.09. Such recording and erasure were repeated 50 times. However, no decrease in the image density and no increase in the background density were observed. The recorded medium was irradiated with light of a 5500 lux fluorescent lamp for 100 hours. However, no discoloration of the image, no coloring of the background and no erasure failure were observed.

EXAMPLE 9

A thermosensitive recording layer was formed in the same manner as described in Example 3 except that the following composition was used as the dispersion:

| | |
|---|---|
| 3-(4-diethylamino-2-ethoxyphenyl)-3-(1-ethyl-2-methylindol-3-yl)-4-azaphthalide | 2 parts |
| Developer No. 4 | 8 parts |
| 15% solution of polyester polyol (TAKELAC U-21 manufactured by Takeda Corporation) in tetrahydrofuran | 150 parts |

The thus obtained recording layer was then overlaid with an intermediate layer in the same manner as that in Example 3. Then, a protecting layer was formed on the intermediate layer in the same manner as that in Example 3 except that the protecting layer forming liquid had the following composition:

| | |
|---|---|
| UV hardenable urethane acrylate resin (C7-157 manufactured by Dai-Nippon Ink) | 10 parts |
| Ethyl acetate | 90 parts |

The thus obtained recording medium was recorded in the same manner as described in Example 3. The measurement with McBeath densitometer RD-914 revealed that the image as density was 0.91 and the background density was 0.10. The sample was then heated with a hot stamp at an erasure temperature of 150° C. and maintained at that temperature for 0.5 second to erase the developed image. The image density in the decolorization state was 0.10. Such recording and erasure were repeated 50 times. However, no decrease in the image density and no increase in the background density were observed. The recorded medium was irradiated with light of a 5500 lux fluorescent lamp for 100 hours. However, no discoloration of the image, no coloring of the background and no erasure failure were observed.

EXAMPLE 10

A thermosensitive recording layer was obtained in the same manner as that in Example 9 and a protecting layer was formed thereon in the same manner as that in Example 4.

The thus obtained recording medium was recorded in the same manner as described in Example 3. The measurement with McBeath densitometer RD-914 revealed that the image density was 0.93 and the background density was 0.10. The sample was then heated with a hot stamp at an erasure temperature of 150° C. and maintained at that temperature for 0.5 second to erase the developed image. The image density in the decolorization state was 0.10. Such recording and erasure were repeated 50 times. However, no decrease in the image density and no increase in the background density were observed. The recorded medium was irradiated with light of a 5500 lux fluorescent lamp for 100 hours. However, no discoloration of the image, no coloring of the background and no erasure failure were observed.

EXAMPLE 11

The following components were placed in a ball mill and ground to a particle size of 1–4 μm and to obtain a coating liquid in the form of a dispersion.

| | |
|---|---|
| 2-anilino-3-methyl-6-diethylaminofluoran | 2 parts |
| Developer No. 3 | 8 parts |
| 5% solution of poly(n-butyl methacrylate) resin (BR102 manufactured by Mitsubushi Rayon Inc.) in tetrahydrofuran | 150 parts |

The coating liquid was applied on a white polyester film with a thickness of 100 μm with a wire bar and the coating was dried at 80° C. to form a thermosensitive recording layer with a thickness of about 6 μm on the polyester film. An intimidate layer forming liquid having the following composition was prepared.

| | |
|---|---|
| 10% solution of poly(n-butyl methacrylate) resin (BR102 manufactured by Mitsubushi Rayon Inc.) in methyl ethyl ketone | 100 parts |
| Fine particulate zinc oxide (average diameter: 20 nm) | 10 parts |

The above liquid was applied onto the above thermosensitive recording layer with a wire bar and the coating was dried at 80° C. to obtain an intermediate layer with a thickness of about 2 μm. A protecting layer was then formed on the intermediate layer in the same manner as that in Example 3 to obtain a thermosensitive recording medium.

The thus obtained recording medium was recorded in the same manner as described in Example 3. The measurement with McBeath densitometer RD-914 revealed that the image density was 1.17 and the background density was 0.10. The sample was then heated with a hot stamp at an erasure temperature of 150° C. and maintained at that temperature for 0.5 second to erase the developed image. The image density in the decolorization state was 0.10. Such recording and erasure were repeated 50 times. However, no decrease in the image density and no increase in the background density were observed. The recorded medium was irradiated with light of a 5500 lux fluorescent lamp for 100 hours. However, no discoloration of the image, no coloring of the background and no erasure failure were observed.

EXAMPLE 12

A thermosensitive recording layer was prepared in the same manner as that in Example 11 and a protecting layer was formed thereon in the same manner as that in Example 4 to obtain a thermosensitive recording medium.

The thus obtained recording medium was recorded in the same manner as described in Example 3. The measurement with McBeath densitometer RD-914 revealed that the image density was 1.22 and the background density was 0.11. The sample was then heated with a hot stamp at an erasure temperature of 150° C. and maintained at that temperature for 0.5 second to erase the developed image. The image density in the decolorization state was 0.11. The recorded medium was irradiated with light of a 5500 lux fluorescent lamp for 100 hours. However, no discoloration of the image, no coloring of the background and no erasure failure were observed.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A reversible thermosensitive recording medium having a support and a thermosensitive layer, the thermosensitive layer including a composition comprising:

an electron donating coloring compound and an electron accepting compound capable of assuming a relatively colored state and a relatively discolored state depending upon the temperature at which the composition is heated and/or the rate at which the composition is cooled after heating, wherein the electron accepting compound is a phenol compound represented by the formula:

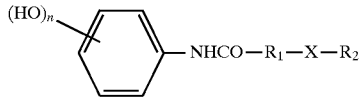

where n is an integer of between 1 and 3, X is a divalent group having a nitrogen atom or an oxygen atom, $R^1$ is a substituted or non-substituted aliphatic hydrocarbon group having at least two carbon atoms and $R^2$ is a hydrocarbon group.

* * * * *